United States Patent [19]

Amelio et al.

[11] Patent Number: 4,654,126

[45] Date of Patent: Mar. 31, 1987

[54] PROCESS FOR DETERMINING THE PLATING ACTIVITY OF AN ELECTROLESS PLATING BATH

[75] Inventors: William J. Amelio, Binghamton; Voya Markovich, Endwell; Carlos J. Sambucetti, Croton-on-Hudson; Donna J. Trevitt, Vestal, all of N.Y.

[73] Assignee: International Business Machines Corporation, Armonk, N.Y.

[21] Appl. No.: 785,128

[22] Filed: Oct. 7, 1985

[51] Int. Cl.[4] ..... G01N 27/46

[52] U.S. Cl. ..... 204/1 T; 204/400; 204/412; 204/434

[58] Field of Search ..... 204/1 T, 400, 434, 412

[56] References Cited

U.S. PATENT DOCUMENTS

| | | | |
|---|---|---|---|
| 2,938,805 | 5/1960 | Agens | 106/1 |
| 2,996,408 | 8/1961 | Lukes | 117/71 |
| 3,075,855 | 1/1963 | Agens | 117/47 |
| 3,075,856 | 1/1963 | Lukes | 117/47 |
| 3,844,799 | 10/1974 | Underkofler et al. | 106/1 |
| 3,925,168 | 12/1975 | Costas | 204/1 T |
| 4,096,301 | 6/1978 | Slominski et al. | 427/430 A |
| 4,132,605 | 1/1979 | Tench et al. | 204/1 T |
| 4,146,437 | 3/1979 | O'Keefe | 204/1 T |
| 4,152,467 | 5/1979 | Alpaugh et al. | 427/8 |
| 4,182,638 | 1/1980 | Cooke | 148/6.15 R |
| 4,276,323 | 6/1981 | Oka et al. | 204/1 T |
| 4,286,965 | 9/1981 | Vanhumbeeck et al. | 23/230 A |
| 4,287,027 | 9/1981 | Tosk | 204/1 T |
| 4,324,621 | 4/1982 | Kerby | 204/1 T |
| 4,336,111 | 6/1982 | Graunke | 204/1 T |

FOREIGN PATENT DOCUMENTS

| | | | |
|---|---|---|---|
| 0152500 | 9/1982 | Japan | 204/434 |
| 0226171 | 12/1984 | Japan | 204/1 T |

OTHER PUBLICATIONS

"Control of Contaminants in Copper Pyrophosphate Circuit Board Production Baths", Ogden, et al., Plating and Surface Finishing, Dec. 1979, pp. 45–46.

Paunovic, "An Electrochemical Control System for Electroless Copper Bath", Journal Electrochemical Society, Electrochemical Science and Technology, vol. 127, No. 2, pp. 365–369.

Mantell, et al., "Current-Potential Effects of Trace Impurities in Manganese Electrowinning", Transactions of the Metallurgical Society of AIME, vol. 236, May 1966, pp. 718–725.

Vennesland, et al., "Current-Potential Effects of Trace Impurities in Zinc Sulfate Electrolyte", Acta Chemica Scandinavica, 27, 1973, No. 3, pp. 846–850.

Mansfeld, "The Copper Plating Bath Monitor", Plating and Surface Finishing, May 1978, pp. 60–62.

Haddad, IBM Technical Disclosure Bulletin, vol. 19, No. 11, Apr. 1977, p. 4156.

*Primary Examiner*—Terryence Chapman

*Attorney, Agent, or Firm*—Pollock, Vande Sande & Priddy

[57] ABSTRACT

A process for monitoring an electroless plating bath to determine whether it is in a take mode by electrolessly depositing a film of the metal of the plating bath onto a substrate to provide a preplated cathode; providing the cathode, a reference electrode, and an anode in the electroless bath; passing an electric current and varying the voltage difference, plotting the voltage difference versus the current; and comparing the oxidation peak of the reducing agent to the oxidation peak of the reduced state of the metal ion to be plated to thereby determine whether the bath is in a take mode.

11 Claims, 7 Drawing Figures

PROCESS FOR DETERMINING THE PLATING ACTIVITY OF AN ELECTROLESS PLATING BATH

DESCRIPTION

1. Technical Field

The present invention is concerned with electroless metallic plating baths and is especially concerned with a process for monitoring the baths in order to determine whether such are in a take mode. In other words, the present invention is concerned with a process for monitoring an electroless plating bath in order to determine whether the energy of the bath is sufficient to plate onto a desired substrate.

Accordingly, the present invention is concerned with electroless plating baths which are capable of initial plating onto a desired substrate. The present invention is concerned with the utilization of voltammetry to determine whether the electroless plating bath is in a take mode.

2. Background Art

Electroless plating is well-known in the prior art and especially for plating of copper, nickel, and gold and more especially for copper. In particular, an electroless or autocatalytic copper plating bath usually contains a cupric salt, a reducing agent for the cupric salt, a chelating or complexing agent, and a pH adjustor. Moreover, if the surface being plated is not already catalytic for the deposition of the metal, such as the copper, a suitable catalyst is deposited on the surface prior to contact with the electroless plating bath. Among the more widely employed procedures for catalyzing a substrate is the use of a stannous chloride sensitizing solution and a palladium chloride activator to form a layer of metallic palladium particles.

In manufacturing very high-quality articles, such as printed circuits, normally an initial electroless plating operation is employed which is generally referred to as a strike- or flash-bath followed by subsequent electroless plating employing the main bath, or followed by a subsequent electro-deposition plating procedure in order to obtain the desired thickness of the copper layer.

The strike-bath is formulated in order to promote the initial copper plating on the catalytic surfaces. Generally, the substrates are subjected to a strike-bath for about one hour and then transferred to the main additive electroless copper plating bath for an additional fifteen to twenty hours. The strike-bath is formulated by design to be much more chemically active than the main additive bath. However, although strike-baths are more chemically active than the main bath, certain problems occur with such baths. For instance, at times the strike-bath, for one reason or the other, does not result in initial plating on the activated surfaces. This, in turn, can result in products which must be discarded in view of voids which may be present, for instance, in the holes and/or on the substrates being coated.

Moreover, there is a delicate balance between providing a bath which is sufficiently chemically active so as to provide take or initial plating and to prevent the bath from going out of control, resulting in the formation of what is known as extraneous metal such as extraneous copper or nodules.

The proper control of the strike- or flash-bath, as well as the main bath, has been of particular concern as the demand for higher quality articles increases. For instance, various attempts at controlling electroless copper plating baths for maintaining preselected concentrations of certain components in the plating bath have been suggested. For instance, see U.S. Pat. No. 4,096,301 to Slominski, et al. and U.S. Pat. No. 4,286,965 to Vanhumbeeck, et al. which are examples of suggestions for maintaining preselected concentrations of components in a plating bath.

SUMMARY OF INVENTION

The present invention is concerned with a process for monitoring an electroless metallic plating bath in order to determine whether the bath is in a take mode. The process comprises preparing a cathode by electrolessly depositing a film of the metal of the plating bath onto a substrate which is catalytic for the deposition of the metal. This is achieved by immersing the substrate in the electroless plating bath and then electrolessly preplating the metal on the substrate. The preplated cathode, a reference electrode, and an anode are provided within the electroless metallic plating bath. An electric current is passed between the cathode and the anode and the voltage difference between the cathode and the reference electrode is varied in the direction to thereby remove electrolessly plated metal from the preplated cathode. The voltage difference between the cathode and the reference electrode is plotted versus the current. The oxidation peak of the reducing agent of the electroless bath is compared to that of the reduced state of the metal ion to be plated in order to determine if the plating bath is in a take mode.

BEST AND VARIOUS MODES FOR CARRYING OUT INVENTION

Figure 1:
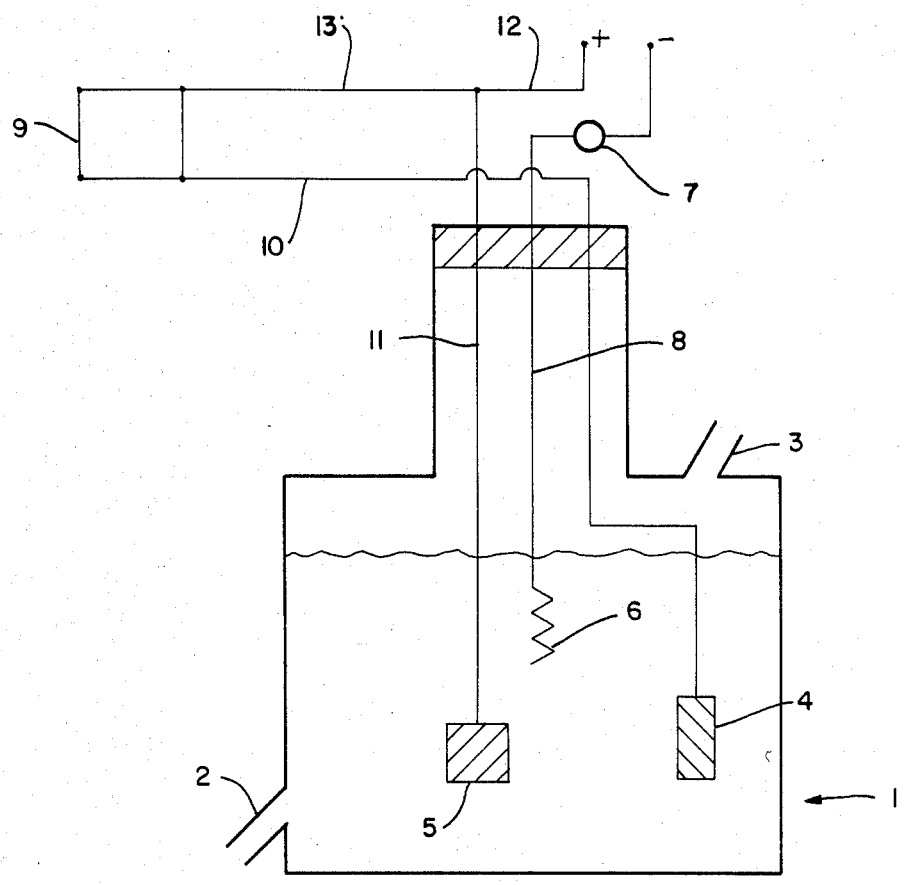
FIG. 1 is a schematic diagram of an electrochemical apparatus suitable for carrying out the process of the present invention.

The present invention is concerned with a process for monitoring an electroless metallic plating bath in order to determine whether the bath is in a take mode. In the preferred aspects of the present invention, the electroless plating baths are electroless copper plating baths. Accordingly, the discussion which follows will be directed to electroless copper plating baths for convenience in understanding the present invention. However, it is understood that the present invention is also applicable to other electroless metal plating baths, such as nickel and gold.

Examples of electroless copper plating baths can be found in U.S. Pat. Nos. 3,844,799 and 4,152,467, disclosures of which are incorporated herein by reference.

The copper electroless plating bath is generally an aqueous composition which includes a source of cupric ion, a reducing agent, a complexing agent for the cupric ion, and a pH adjuster. The plating baths can also include a cyanide ion source and a surface-active agent.

The cupric ion source generally used is a cupric sulfate (e.g., $CuSO_4.5H_2O$) or a cupric salt of the complexing agent to be employed.

Amounts of cupric ion source from about 3 to about 15 g/l, calculated as $CuSO_4.5H_2O$, are generally used. The most common reducing agent employed is formaldehyde which is usually used in amounts from about 0.7 to about 7 g/l.

Examples of some other reducing agents include formaldehyde precursors or derivatives such as paraformaldehyde, trioxane, dimethylhydantoin, glyoxal; borohydrides such as alkali metal borohydrides (sodium and potassium borohydride) and substituted borohydrides such as sodium trimethoxy borohydride; boranes such as amine borane (isopropyl amine borane and morpholine borane).

Examples of some suitable complexing agents include Rochelle salts, ethylene diamine tetraacetic acid, the sodium (mono-, di-, tri-, and tetra-sodium) salts of ethylene diamine tetraacetic acid, nitrolotetraacetic acid and its alkali salts, gluconic acid, gluconates, triethanol amine, glucono (gamma)-lactone, modified ethylene diamine acetates such as N-hydroxyethyl, and ethylene diamine triacetate. In addition, a number of other suitable cupric complexing agents are suggested in U.S. Pat. Nos. 2,996,408; 3,075,856; 3,075,855; and 2,938,805. The amount of complexing agent is dependent upon the amount of cupric ions present in the solution and is generally from about 20 to about 50 g/l.

The plating bath can also include a surfactant which assists in wetting the surface to be coated. A satisfactory surfactant is, for instance, an organic phosphate ester available under the trade designation "Gafac RE-610". Generally, the surfactant is present in amounts from about 0.02 to about 0.3 g/l. In addition, the pH of the bath is also generally controlled, for instance, by the addition of a basic compound such as sodium hydroxide or potassium hydroxide in the desired amount to achieve the desired pH. Such is between about 11.6 and 11.8.

Also, the plating bath may contain a cyanide ion such as in amounts of about 10 to about 25 mg/l to provide a cyanide ion concentration in the bath within the range of 0.0002 to 0.0004 molar. Examples of some cyanides which can be employed according to the present invention are the alkali metal, alkaline earth metal, and ammonium cyanides. In addition, the plating bath can include other minor additives as is known in the art.

The plating baths employed generally have a specific gravity within the range of 1.060 to 1.080. Moreover, the temperature of the bath is usually maintained between about 70° C. and 80° C., more usually between about 70° C. and 75° C. and most often about 73° C.

For a discussion of the plating temperature coupled with the cyanide ion concentrations, see U.S. Pat. No. 3,844,799.

Also, it is generally desirable to maintain the $O_2$ content of the bath between about 2 ppm and 4 ppm and more usually about 2.5 ppm to about 3.5 ppm, as discussed in U.S. Pat. No. 4,152,467. The $O_2$ content can be controlled by injecting oxygen and an inert gas into the bath.

The overall flow rate of the gases into the bath is generally from about 1 to about 20 SCFM per thousand gallons of bath and more usually from about 3 to about 8 SCFM per thousand gallons of bath. In accordance with the present invention, it is essential to employ as the cathode a substrate having electrolessly deposited thereon a film of the metal of the plating bath. The substrate employed must be one which is catalytic for the deposition of the metal thereon. Examples of suitable substrates for copper include palladium and platinum substrates. In addition, it is preferred that the electroless plating to form the cathode be carried out at the actual temperature at which the bath is to be employed. The electroless plating is carried out to provide a uniform film of the metal thereon and usually takes about ½ to about 2 minutes. The thickness of the metal film is usually about 200 angstroms to about 1000 angstroms on the substrate.

The preplated cathode, a reference electrode, and an anode are provided in the electroless plating bath. Suitable reference electrodes are saturated calomel electrode and silver/silver chloride.

The anode surface is generally platinum or palladium. The anode surface area is usually about the same as to about twice the surface area of the cathode.

An electric current is passed between the cathode and the anode. The current density is usually in the range of about 0.05 milliamperes/$cm^2$ to about 5 milliamperes/$cm^2$ of cathode surface area (one side) and preferably about 1 to about 2 milliamperes/$cm^2$ of cathode surface area (one side). The voltage difference between the cathode and the reference electrode is varied in the direction to thereby remove or oxidize the electrolessly plated metal off of the cathode. When employing a electroless copper plating bath of the type discussed hereinabove, the voltage is varied between about −0.8 volts versus a saturated calomel electrode for a platinum anode and increased at a rate of about 50 to about 100 millivolts per second, up to about −0.2 volts. During this time, the electrodes are maintained in a stationary position. This is important in order to assure proper recording of the voltage and current conditions. The varying of the voltage results in oxidation of the metal and removal thereof from the cathode. At the point at which the metal is removed, the current is stopped so as not to create an electroplating process. Moreover, only one cycle of the varying voltage is employed in order to obtain the desired plot of the voltage versus the current.

For baths of the type discussed hereinabove, the peak of the reducing agent and particularly the formaldehyde is at about −0.5 volts versus saturated calomel electrode and that of the copper in its reduced ionic form (i.e., $Cu^+$) is about −0.35 volts. The peak of the oxidation of the formaldehyde and that of the $Cu^+$ is compared in order to determine whether the plating bath is in a take mode and also to determine the relative activity of the bath.

Figure 2:
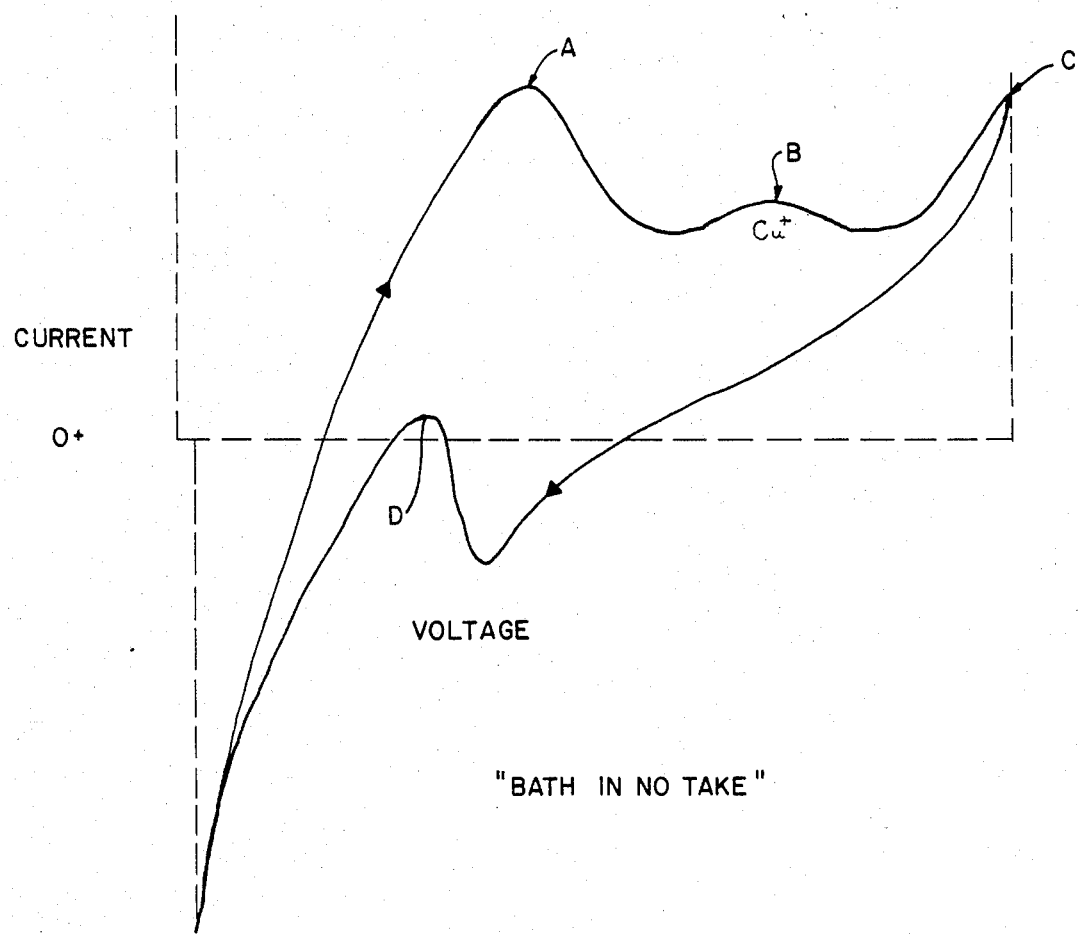
FIG. 2 is a plot of the voltage versus current for a bath which did not provide take.
Figure 3:
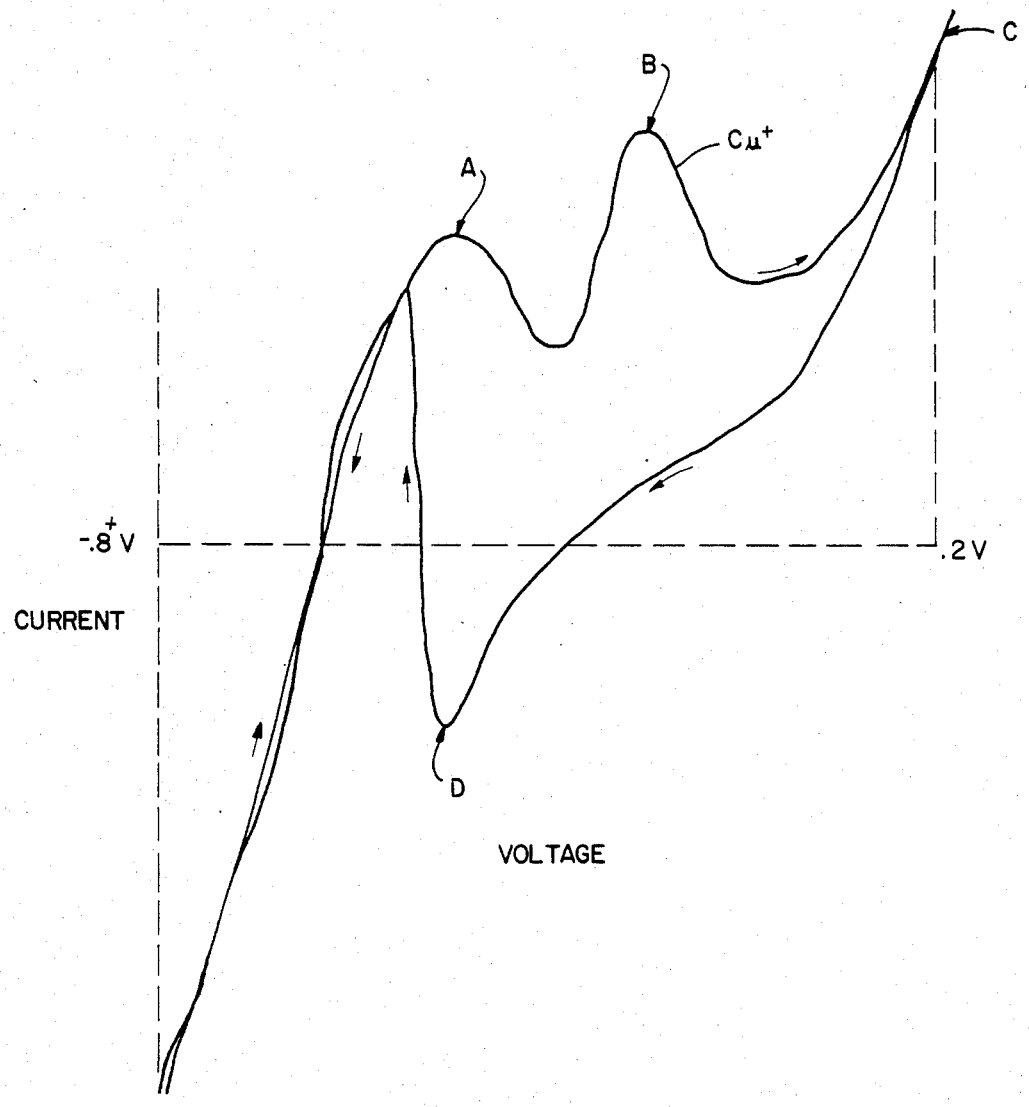
FIGS. 3–6 are plots of voltage versus current for baths which are in a take mode.
Figure 4:
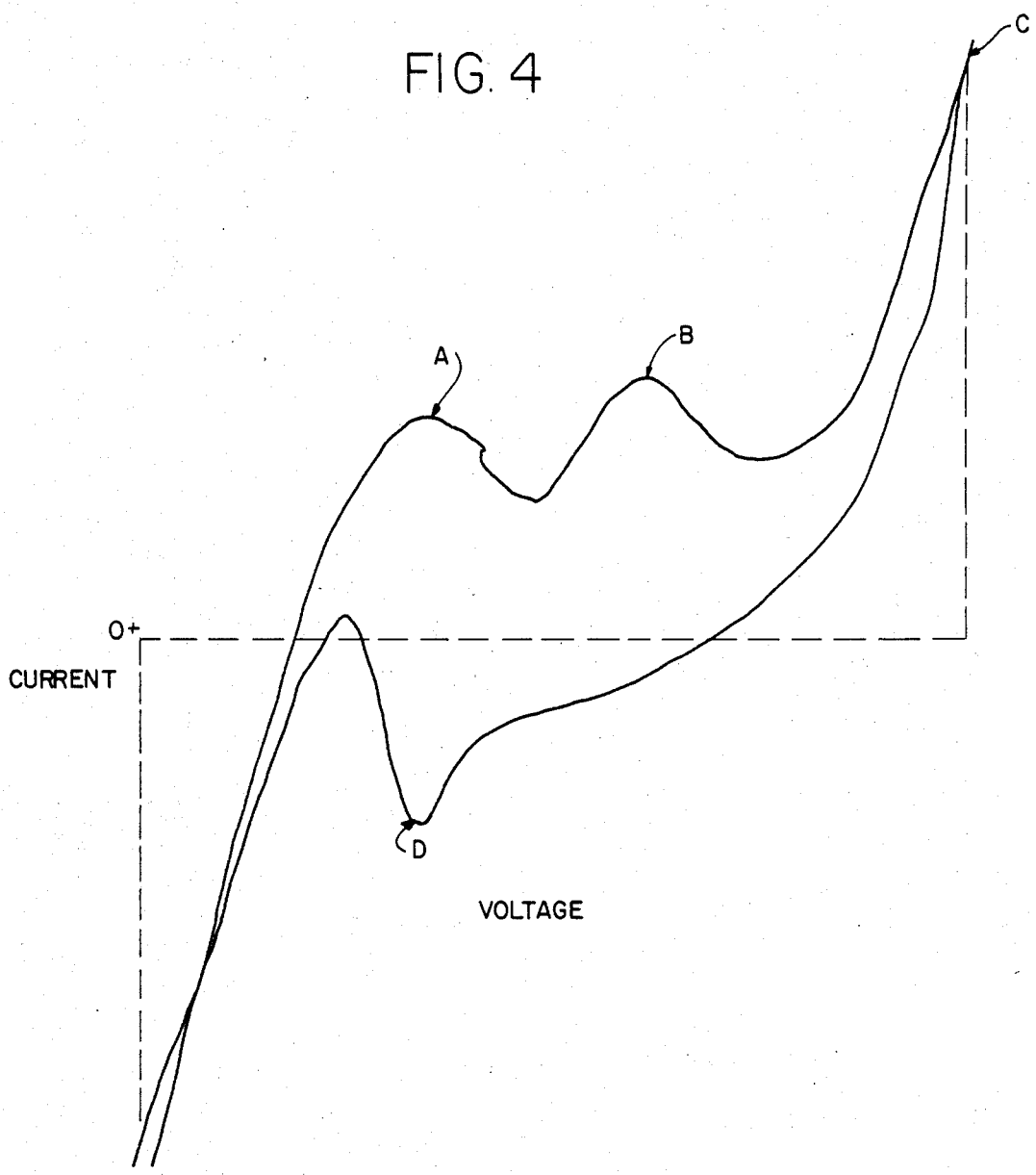

In particular, in order for the bath to be in the take mode it is necessary that the peak of the formaldehyde be equal to or less than the peak for the $Cu^+$. Otherwise, the bath will be in a no-take or inactive mode. In particular, FIG. 2 illustrates a voltage versus current plot whereby the formaldehyde peak was greater than the $Cu^+$ peak and the bath was, accordingly, not in the take mode. With respect to FIG. 2, the designation A refers to the formaldehyde peak; the designation B refers to the $Cu^+$ peak; the designation C refers to the $Cu^{++}$ and complexing agent peak; and the point designated D refers to the reverse formaldehyde peak.

Figure 5:
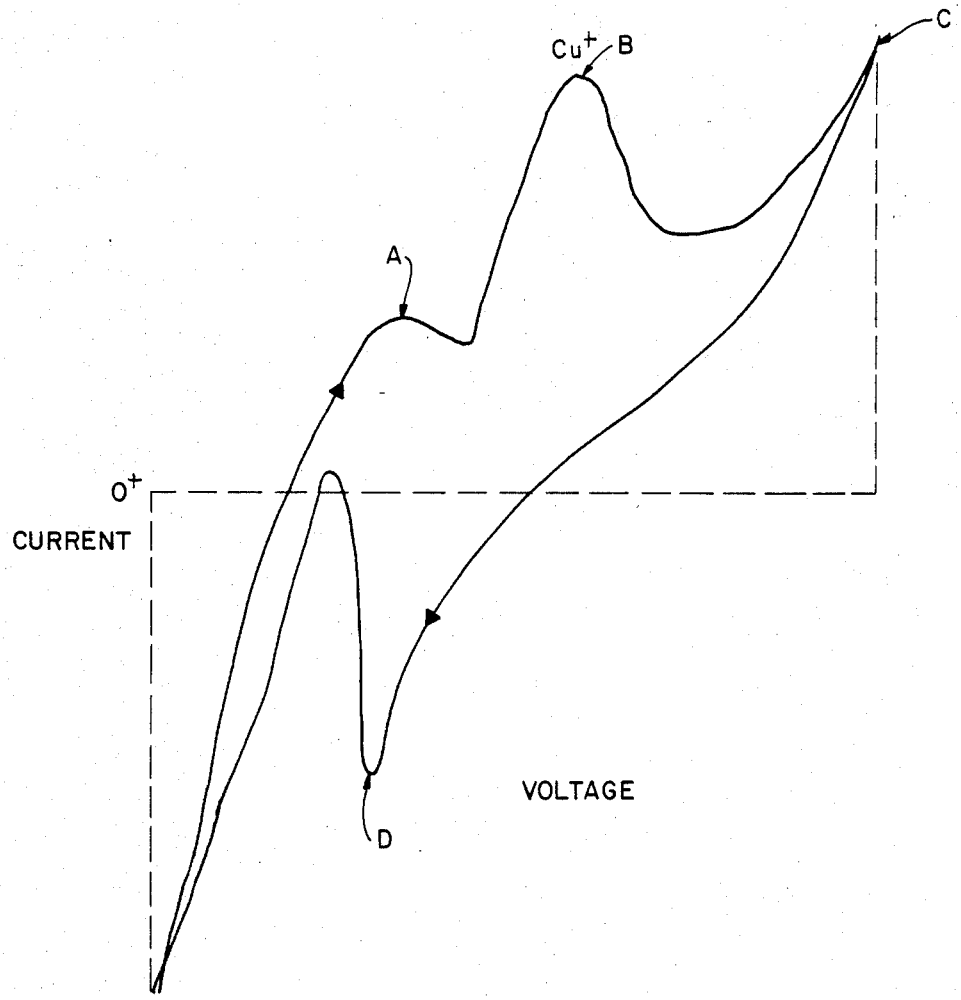
Figure 6:
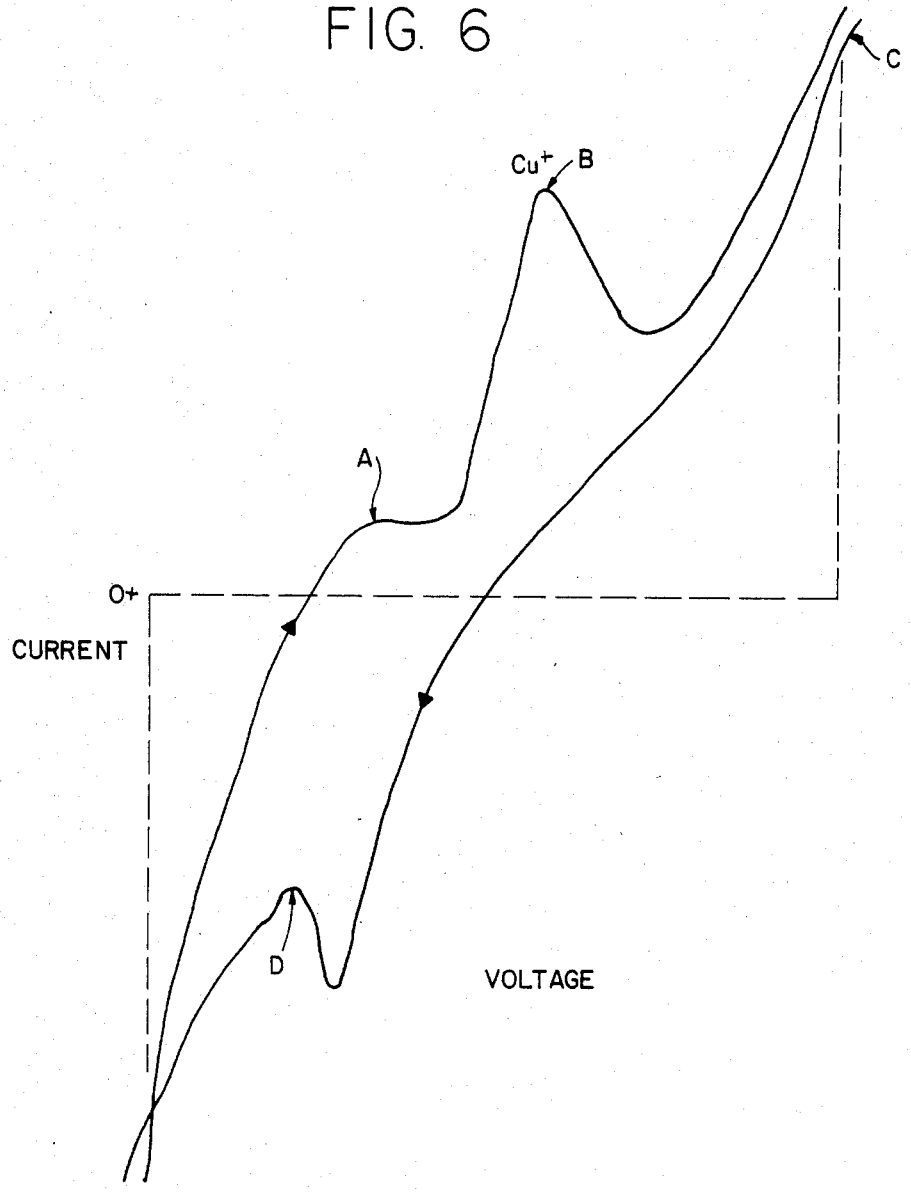

FIGS. 3 through 6 are plots of voltage versus current for various baths which are in the take mode. The designations A, B, C, and D are the same as those for FIG. 2. It is noted that the baths in the take mode which are least susceptible to nodule formation are those whereby the formaldehyde peak and the $Cu^+$ peak are substantially equal to each other. As the $Cu^+$ peak tends to significantly exceed that of the formaldehyde peak, the possibility of nodule formation increases as illustrated in FIGS. 5 and 6. In effect, the baths from which the results of FIGS. 5 and 6 are obtained are extremely highly active.

Figure 7:
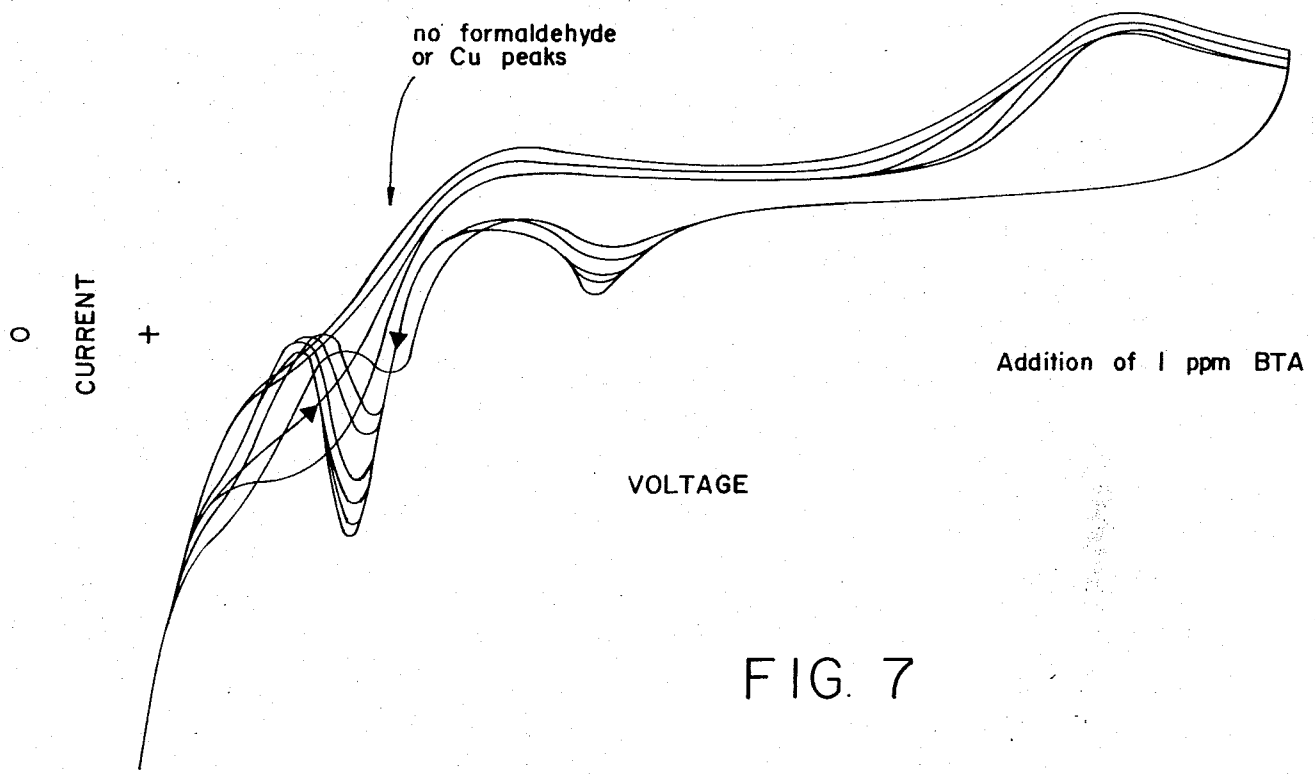
FIG. 7 is a plot of voltage versus current in a passive bath whereby neither $Cu^+$ or formaldehyde peaks are formed.

FIG. 7 is a plot of the voltage versus current illustrating a passive bath whereby neither formaldehyde or $Cu^+$ peaks are formed. Such indicates the presence of some trace impurity which causes the bath to become passive. In the case illustrated in FIG. 7, BTA was added to the bath in a few ppm amounts.

Reference to FIG. 1 illustrates apparatus suitable for carrying out the process of the present invention. In particular, there is shown a container designated by 1 for containing the electrodes and bath composition to be monitored. The plating bath is conveyed to the testing apparatus via conduit 2 and is maintained at the plating temperature which, for the above defined copper plating baths, is about 72° C.±2° C. and exits the testing apparatus via conduit 3. Immersed in the plating bath is the reference electrode 4, the preplated cathode 5, and the metal anode (counter electrode) 6.

The anode 6 is electrically connected to ammeter 7 and to the negative pole of a controlled current-potential source (not shown) via ohmic connection 8. Reference electrode 4 is electrically connected to a potential recording device 9 via ohmic connection 10. The cathode 5 is electrically connected to the positive pole of a controlled current-potential source (not shown) via ohmic connectors 11 and 12. The cathode 5 is electrically connected to potential recording device 9 via connectors 11 and 12.

Potential recording device 9 records the voltage differential between the reference electrode 4 and the cathode or working electrode 5.

Having thus described our invention, what we claim as new and desire to secure by Letters Patent is:

1. A process for monitoring an electroless metallic plating bath containing a reducing agent to determine whether said bath is in a take mode which comprises:

a. preparing a cathode by electrolessly depositing a film of the metal of said plating bath onto a substrate which is catalytic for the deposition of said metal by immersing the substrate in said electroless plating bath and electrolessly preplating said metal thereon;

b. providing in said electroless plating bath, along with said cathode of step a., a reference electrode and an anode;

c. passing an electric current between said cathode and said anode and varying the voltage differences between said cathode and said reference electrode to thereby remove electrolessly plated metal from said cathode;

d. plotting said voltage differences between said cathode and said reference electrode versus the current to provide a plot of said voltage differences versus said current; and e. comparing the peak of said plot that represents the oxidation peak of the reducing agent of the electroless bath to the peak of said plot that represents the peak of the reduced state of the metal ion to be plated to determine if the plating bath is in a take mode.

2. The process of claim 1 wherein said plating bath is an electroless copper plating bath.

3. The process of claim 2 wherein said reducing agent if formaldehyde and said reduced state of the metal ion is $Cu^+$.

4. The process of claim 2 wherein the voltage is varied from about −0.8 volts to about −0.2 volts versus a saturated calomel electrode.

5. The process of claim 4 wherein the voltage is varied at a rate of about 100 to about 50 millivolts per second.

6. The process of claim 1 wherein the electrolessly depositing to form the cathode is carried out at the temperature at which the plating bath is to be employed.

7. The process of claim 6 wherein said temperature is about 70° C. to about 80° C.

8. The process of claim 6 wherein said temperature is about 70° C. to about 75° C.

9. The process of claim 6 wherein said temperature is about 73° C.

10. The process of claim 1 wherein the reference electrode, cathode, and anode are substantially stationary during the varying of the voltage.

11. The process of claim 1 wherein the anode is platinum or palladium.

* * * * *